US007878424B2

(12) United States Patent
Schnuckle

(10) Patent No.: US 7,878,424 B2
(45) Date of Patent: Feb. 1, 2011

(54) PERSONAL MISTING DEVICE WITH MANUALLY-OPERATED AND RETRACTABLE FOLDING FAN

(75) Inventor: Gary W. Schnuckle, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 106 days.

(21) Appl. No.: 12/274,827

(22) Filed: Nov. 20, 2008

(65) Prior Publication Data

US 2010/0123023 A1 May 20, 2010

(51) Int. Cl.
*B05B 15/00* (2006.01)

(52) U.S. Cl. ..... 239/289

(58) Field of Classification Search ..... 239/289, 239/214.23, 214.25, 215, 222.11, 29.3, 349; 222/333, 383.1; 261/28, 78.2, 90
See application file for complete search history.

(56) References Cited

U.S. PATENT DOCUMENTS

| | | | | |
|---|---|---|---|---|
| 4,839,106 | A * | 6/1989 | Steiner | 261/28 |
| 5,338,495 | A * | 8/1994 | Steiner et al. | 261/28 |
| 5,843,344 | A | 12/1998 | Junkel et al. | |
| 6,230,723 | B1 * | 5/2001 | Hixson | 135/16 |
| 6,378,845 | B1 | 4/2002 | Hsu | |
| 6,682,000 | B1 | 1/2004 | Apple | |
| 6,827,290 | B2 * | 12/2004 | Zimmerman | 239/215 |
| 6,886,759 | B1 | 5/2005 | Okronick et al. | |
| 7,104,270 | B2 | 9/2006 | Dong | |
| 7,104,486 | B2 * | 9/2006 | Hiraguchi | 242/338.1 |
| 7,153,100 | B2 * | 12/2006 | Frampton et al. | 416/5 |
| D544,078 | S | 6/2007 | Geringer | |
| D554,242 | S | 10/2007 | Chen | |
| 7,395,676 | B2 * | 7/2008 | White | 62/310 |
| 2006/0273195 | A1 | 12/2006 | Junkel | |
| 2008/0048051 | A1 * | 2/2008 | Chang | 239/289 |

* cited by examiner

*Primary Examiner*—Davis Hwu
(74) *Attorney, Agent, or Firm*—Marsh Fischmann & Breyfogle LLP; Kent A. Lembke

(57) ABSTRACT

A compact personal misting device with no motors or batteries. The device includes a liquid container and a spray pump assembly with a fluid inlet tube that extends into the container. The pump assembly includes an atomizer nozzle operable to output mist using the liquid. The misting device also includes a folding fan pivotally mounted on the container that is selectively positioned in a storage position in which a flexible fan blade is retracted upon itself and also in a cooling position with the fan blade unfolded to extend outward from the container. The fan blade is formed of a flexible material that in the cooling position is substantially planar, e.g., a semi-circular shape. The atomizer nozzle outputs the mist in a target direction that is transverse to the plane containing the unfolded fan blade with the nozzle targeted about 90 degrees from the fan blade in some cases.

17 Claims, 5 Drawing Sheets

PERSONAL MISTING DEVICE WITH MANUALLY-OPERATED AND RETRACTABLE FOLDING FAN

BACKGROUND OF THE INVENTION

1. Field of the Invention

The present invention relates, in general, to evaporative cooling devices for individual use such as personal misting devices, and, more particularly, to a portable or personal misting device that uses a manually-operated fan rather than a battery-operated fan and that, in most cases, does not direct spray through spinning fan blades.

2. Relevant Background

Portable misting devices are used worldwide to allow individuals to cool themselves while attending sporting events and other outdoor activities such as amusement parks. In general, these devices make use of evaporative cooling and provide a mist of water on a person's skin that is then evaporated by air flowing from a fan. In other words, existing misting devices typically provide a combination of a battery operated fan to provide a flow of air and a pump adapted to provide an atomized mist spray of water. While misting devices have been widely popular, there is a demand for new designs that address problems with existing products such as their weight and cost and to also expand the existing market size.

Existing spray misting devices use a portable-sized fan for creating a cooling airflow with well-know rotary fans that are battery powered. The use of batteries and a battery-powered fan motor causes the misting device to be relatively heavy. The batteries also increase the overall cost of the devices and present other issues such as a need to periodically replace the batteries (e.g., the fan may stop working in the middle of an event) and to handle the disposal of the batteries in an environmentally safe manner. Hence, it would be desirable to provide a personal mister device that does not require use of batteries.

A typical misting device includes a body or bottle with a hollow interior that holds a volume of liquid and an applicator or pump assembly for providing an atomized mist spray of the liquid. A clip assembly is provided for securing the liquid container or body to the rear of a rotary fan unit so that the applicator or pump outlet is located in proximity to the fan blades. During use, a user of the device presses on a finger trigger or lever of a pump, and the applicator generates an atomized mist spray. The water is delivered in a direction the fan blades are directing air to create a current of air to deliver the mist and water to a user's skin. The atomized water is sprayed through the spinning fan blades, and this is effective for delivering the water to the user but causes other problems. Specifically, some of the mist of each spray contacts and collects on the fan blades. This water then is wicked rapidly to the ends of the blades and whipped off as drops of water, which may strike the user or, more typically, other people located to the side of the person holding the misting device. A number of misting device designs have attempted to resolve the problem with misdirected and leaking water, and these designs often have included a water shield or collection device positioned about the periphery of the fan blades. The water then may drip down the shield onto the users hands or into an additional collection reservoir. There remains a demand for an improved design for delivering atomized water or mist that addresses problems with spraying water through rotating fan blades.

SUMMARY OF THE INVENTION

The present invention addresses the above problems by providing a personal misting device that simplifies the function and design, reduces manufacturing and operation costs, and improves the effectiveness of existing cooling devices. Briefly, embodiments of the personal misting devices described herein combine a handheld folding fan or flip fan with a water container and atomizing spray pump to create a simple, convenient, and superior functioning personal cooling device. In a storage configuration or position, the folding fan is retracted or folded with its fabric body (or fan blade or "sail") positioned near the water container. In a cooling or use position, the folding fan is expanded or unfurled with the fabric blade or sail positioned in its generally planar and semi-circular arrangement. The device is then operated manually by a user grasping the container and rotating it to generate a cooling air flow and by triggering the spray pump to discharge water that is atomized to provide a mist that lands on their skin such that the combination of moistened skin and flowing air provides an evaporative cooling effect.

The personal cooling devices provide a number of advantages over prior battery operated misters. For example, no motors or batteries are required for operation of the fan which lowers cost and weight of the cooling device and also reduces environmental impacts related to battery disposal and eliminates the risk that the device simply will not be operable when needed (e.g., when a battery dies at an event). Depending on the size of the fan and input by the user, the devices are expected to provide improved air flow (i.e., increase volumetric flow rate of air) for an increased evaporative cooling effect when compared with typical motorized fans in existing devices. The flip out and retractable aspects of the folding fan are likely to excite consumers especially younger buyers as they provide an element of fun or entertainment (e.g., a switch blade-like functionality) not available with existing misting devices. The unfurled or expanded fan blade (planar or somewhat ridged surface) provides a large, visible surface area (semicircular planar or somewhat ridged surface area) that can be used to contain artwork or text (e.g., fan blade data) such as branding, advertisements, movie or television characters, and/or personalities information such as the owner's name or the like, which will increase the value and attractiveness of the personal misting devices to sellers and buyers or the products. The unfolded fan blades also serve other functions not available with rotary fans such as providing a shade or sun block to sunlight. The personal misting devices may also be sized (e.g., 6 to 12 inches in length, about 3 to 6 inches in width, and 0.5 to 3 inches in depth or the like) such that in the stored or retracted position of the fan blade the devices may be sold or distributed via vending machines, may easily be carried and stored by the user, and may more readily be shipped and stored/warehoused due to its compact size compared with existing personal mister designs.

More particularly, a personal cooling apparatus is provided that is compact and requires no motors or batteries to operate. The cooling apparatus includes a container with a chamber for containing a volume of liquid. A pump or spray assembly is included with a fluid inlet tube that extends into the liquid chamber and also includes an atomizer nozzle operable to output mist from a portion of the liquid received from the fluid inlet tube (e.g., when a pump trigger mechanism is depressed drawing water or other liquid from the container through the tube and nozzle). Significantly, the cooling apparatus further includes a folding fan pivotally mounted on the container. The folding fan is selectively positionable or retractable in a storage position with a fan blade that is retracted and positionable/unfurled into a cooling position with the fan blade unfolded and extending outward from the container.

The fan blade is formed of a flexible material (such as a sheet of fabric, a thin sheet of plastic provided via injection molding, ultrasonic welding to plastic splines, or other plastic fabrication methods, or other materials) that in the storage position is folded into a compressed form factor (e.g., a small rectangle with the blade material accordioned upon itself) but in the cooling position is arranged to be substantially planar (e.g., a semi-circular shape with small ridges and valleys where folding occurred). The atomizer nozzle outputs the mist in a target direction that is transverse to the plane containing the unfolded fan blade, and, in some embodiments, the misting direction (or output of the nozzle) is substantially orthogonal to the fan blade. The folding fan may include a plurality of planar inner segments attached to an inner portion of the fan blade proximate to the container, and the inner segments may be pivotally mounted to a support arm (e.g., a pin or axle rod extending through an end of the segments) that extends outward from the container. The apparatus may also include a resilient release mechanism or pivotal support mechanism that is connected to at least one of the inner segments (which in turn is attached to an edge or other portion of the fan blade), and the release mechanism may be selectively operable to apply a spring or rotation force to the attached inner segments to urge the fan blade into the cooling or unfolded position by pivoting the inner segments upon the support arm.

DETAILED DESCRIPTION OF THE PREFERRED EMBODIMENTS

Briefly, embodiments of the present invention are directed to personal misting or cooling devices that include a foldable or flip fan combined with a spray assembly on a water container with an atomizing nozzle. Both the fan and the spray assembly are manually operated such that no motors or batteries are required to operate the device, which reduces the production costs, lowers environmental concerns as no batteries need to be disposed of, and significantly reduces weight and size of the device. The fan includes a blade or body that can be selectively positioned in a cooling or use position in which the fan blade is unfolded or unfurled to be substantially planar (e.g., planar body with some ridging where fabric was previously folded upon itself) and typically takes the shape of a semicircle such as 120 to 180 degree or more sweep. In a storage or retracted/folded position, the fan blade becomes quite compact such that the storage size of the personal cooling device is substantially the same as the liquid container, which allows for easy storage or carrying by the user and for easy distribution (such as via vending machines). These and other advantages will become clear from the following description.

Figure 1:
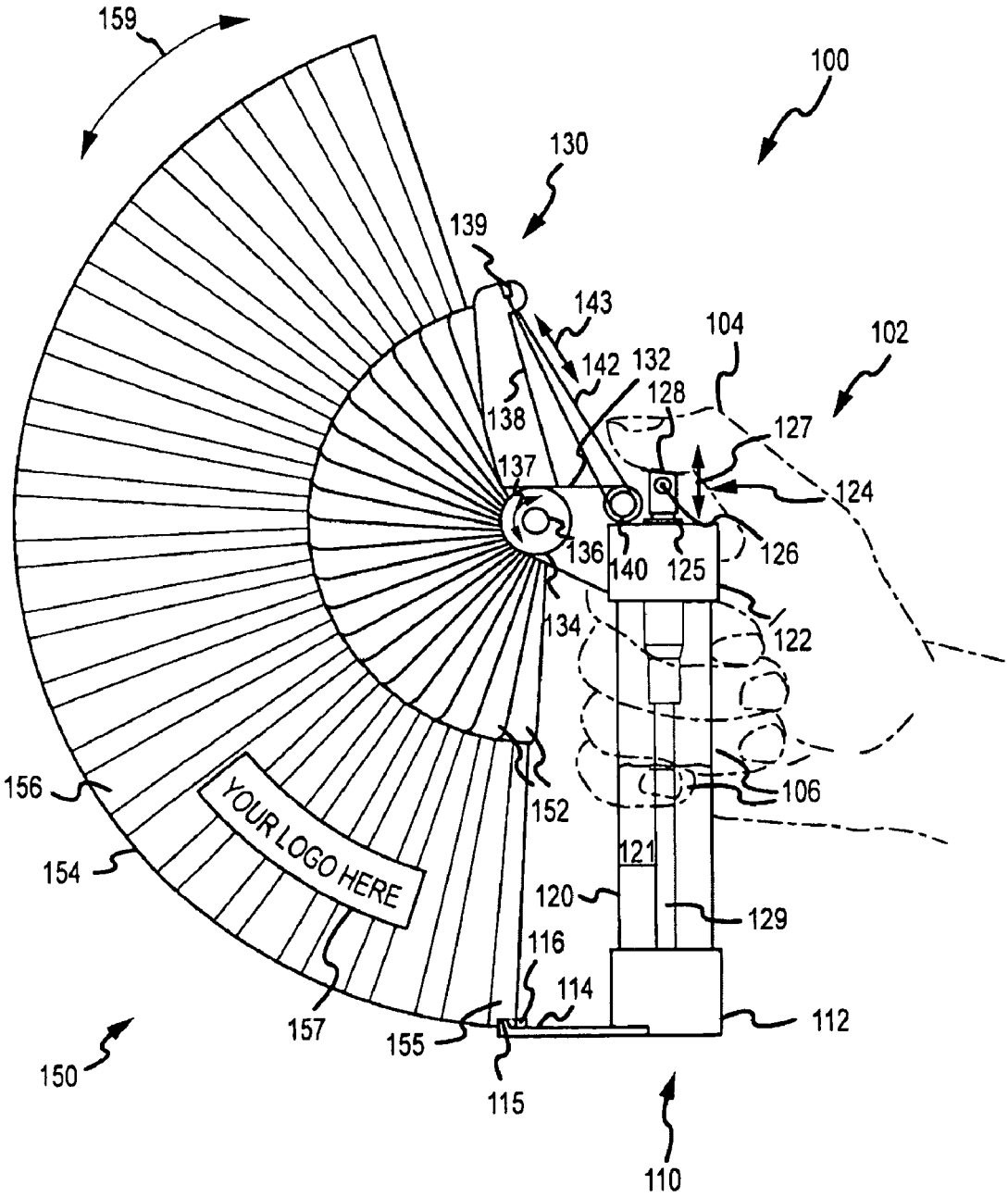
FIG. 1 illustrates a side view of personal misting device or assembly of an embodiment of the invention showing a user operating the assembly and showing the folding or flip fan in the unfurled/unfolded or "in use" position.

FIG. 1 illustrates a personal cooling assembly or misting device 100 of one embodiment of the invention. As shown, the assembly 100 includes a container assembly 110 that includes a base 112 that receives and supports a liquid container 120 with an interior chamber or vessel for containing a volume of liquid 121 such as water. The container assembly 110 also includes a cap 122 for the container 120. A removable spray or liquid pump assembly 124 is provided that includes a connector 125 (such as a threadable connector) for connecting the pump assembly 124 to the container 120. The assembly 124 is removable from the container 120 such that the liquid 121 may be injected or provided into the interior of the container 120 (while in other embodiments, the base 112 may be detachable or include a component for allowing refilling the container 120).

The pump assembly 124 includes a lever or other mechanism 128 that can be compressed or activated manually to actuate the pump of the assembly 125 by pushing it downward as shown at 127, which causes water to be drawn through a straw or tube 129 from container 120 and discharged via atomizer nozzle 126 as a spray or mist. The particular materials and configuration of the container 120 and pump assembly 124 are not limiting of the invention with plastic or glass being commonly used for the container 120 and the container 120 typically containing a few ounces to 24 or more ounces of liquid. Atomizers 124 are well known and a variety may be used in assembly 126 to be activated by a thumb 104 or other finger 106 of a user or operator 102, and the container 120 is typically relatively small in diameter such as less than about 4 inches and more typically less than about 3 inches to allow each gripping/grasp by the user 102 with fingers 106 and the body of the container 120 may be shaped for receiving the user's fingers 106 (e.g., a smaller diameter where the assembly 100 is held).

According to a significant feature of the invention, the personal cooling device 100 includes a foldable or retractable fan 150 that is attached to and/or supported by the container assembly 110. In FIG. 1, the assembly 100 is shown with the fan 150 in the cooling or unfurled/unfolded position. In this position, the fan blade or body 154 is shown as being semicircular and generally planar, with arrow 159 showing the movement as the unfolding or unfurling from a folded or storage position. To allow the unfolding 159, the fan 150 includes a plurality of inner or interior segments 152 that are placed in abutting contact with each other like a stack of cards or the like that are pivotally mounted at one end via pin or axle 136, with motion of the pin or of segments 152 shown at 137. The fan body 154 includes a pair of surfaces 156 upon which artwork, logos, branding, and/or other data 157 may be provided, which is advantageous for creating a product to be sold at theme parks, sporting events, and the like to create buyer demand (e.g., young buyers may want a fan with a particular movie character, athletic fans may want logos for their team, teens may want personalization data or a music group's images, and so on).

Figure 3:
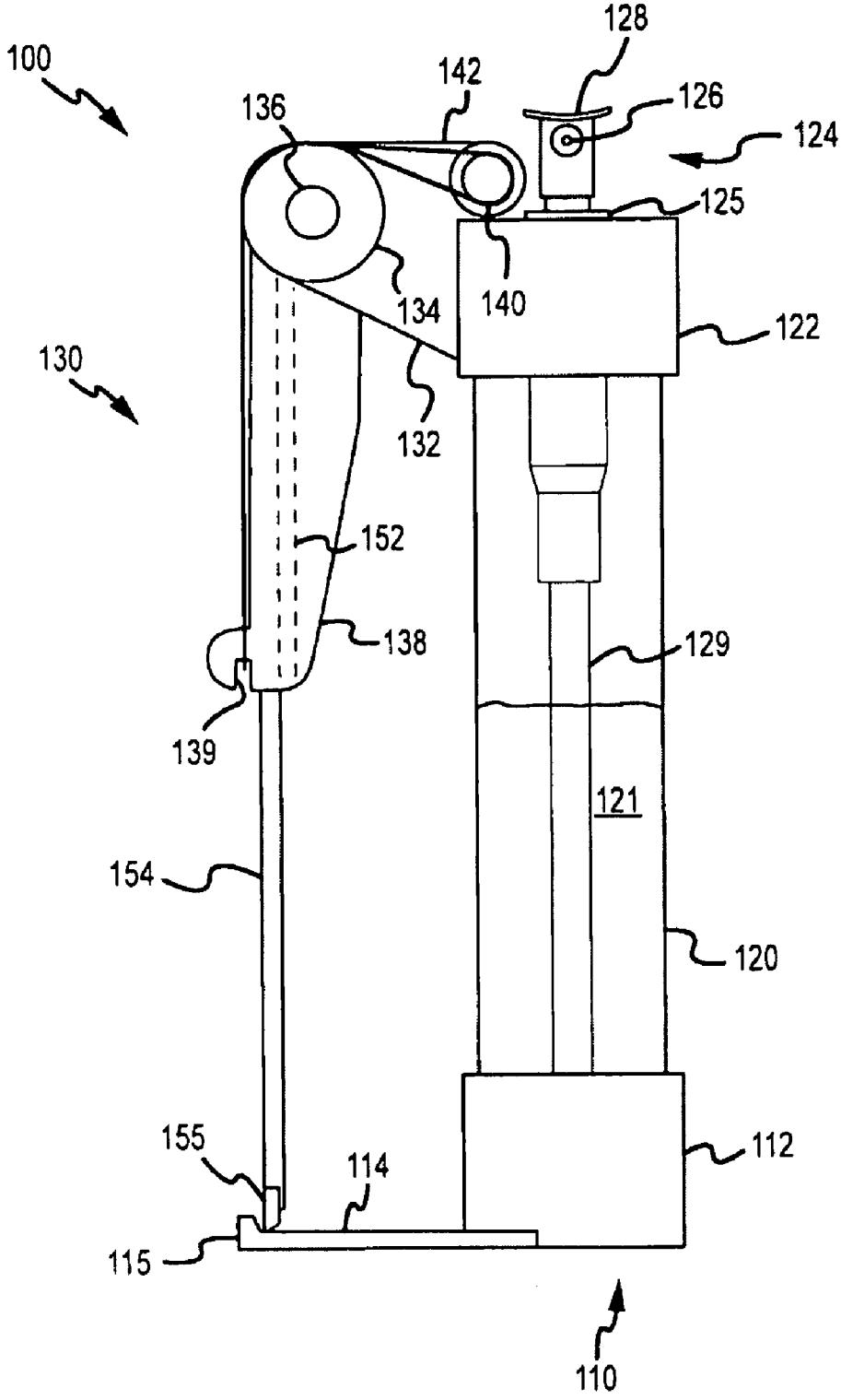
FIG. 3 illustrates a side view similar to FIG. 1 showing the personal misting device of FIGS. 1 and 2 with the folding or flip fan in a retracted/folded or "storage"/non-use position.

To mount the fan 150 on the container assembly 100, the container assembly 100 includes a lower support arm 114 and an upper support arm 132 extending from the lower and upper caps 112, 122, respectively. At the lower support arm 114, an edge member or portion of the fan blade 154 is attached to ridge or wall 116 on support arm 114, with a tip 155 of fan blade 154 being affixed with adhesive or by other methods to the wall 116. A lip 115 may be provided for retaining the fan blade 154 when it is retracted or folded back toward the container 120 and lower support arm 114 as shown in FIG. 3. The upper support arm 132 extends out from the upper cap 122 and includes a mount (e.g., holes or the like) 134 for receiving the pin or axle 136. The inner segments 152 are pivotally supported upon the elongate axle 136 such as with the axle 136 extending through a hole in the segments 152. As a result of this mounting, the fan blade 154 is able to be opened or unfurled 159 as shown with one edge rigidly held at 155 to lower arm 114 about pivot pin 136.

The assembly 100 may be adapted for providing a flip out or switchblade-like action. To this end, an unfolding or expanding assembly 130 is provided that may be thought of as including the support arm 132 and mounting pin 136. An additional inner segment 138 is provided on the second or other edge of the fan blade 154 and mounted on the pin 136. The segment 138 may include a slot or receptacle 139 for receiving a spring member 142 (e.g., a rubber band, a spring, or the like). The spring member 142 extends from a pin/post 140 up to slot 139. The spring member 142 provides a force that assists the blade 154 in unfolding from a storage or folded position to the position shown in FIG. 1 and also to remain this unfurled or unfolded position for use in cooling and/or shading the user 102. In some embodiments, an additional locking mechanism may be provided to lock the member 138 in the unfolded position (such as a latch the may swing out from support arm 132).

The fan blade 154 typically will be formed of a material that can be folded and then unfolded such as a cloth or a plastic-based fabric. The blade 154 may come in a variety of sizes, too, with some embodiments ranging from about 3 inches to about 18 inches in radius with some embodiments using 6 to 10 inch radius blades. The segments 138, 152 and other component typically will be formed from lightweight materials such as wood or plastic.

Figure 2:
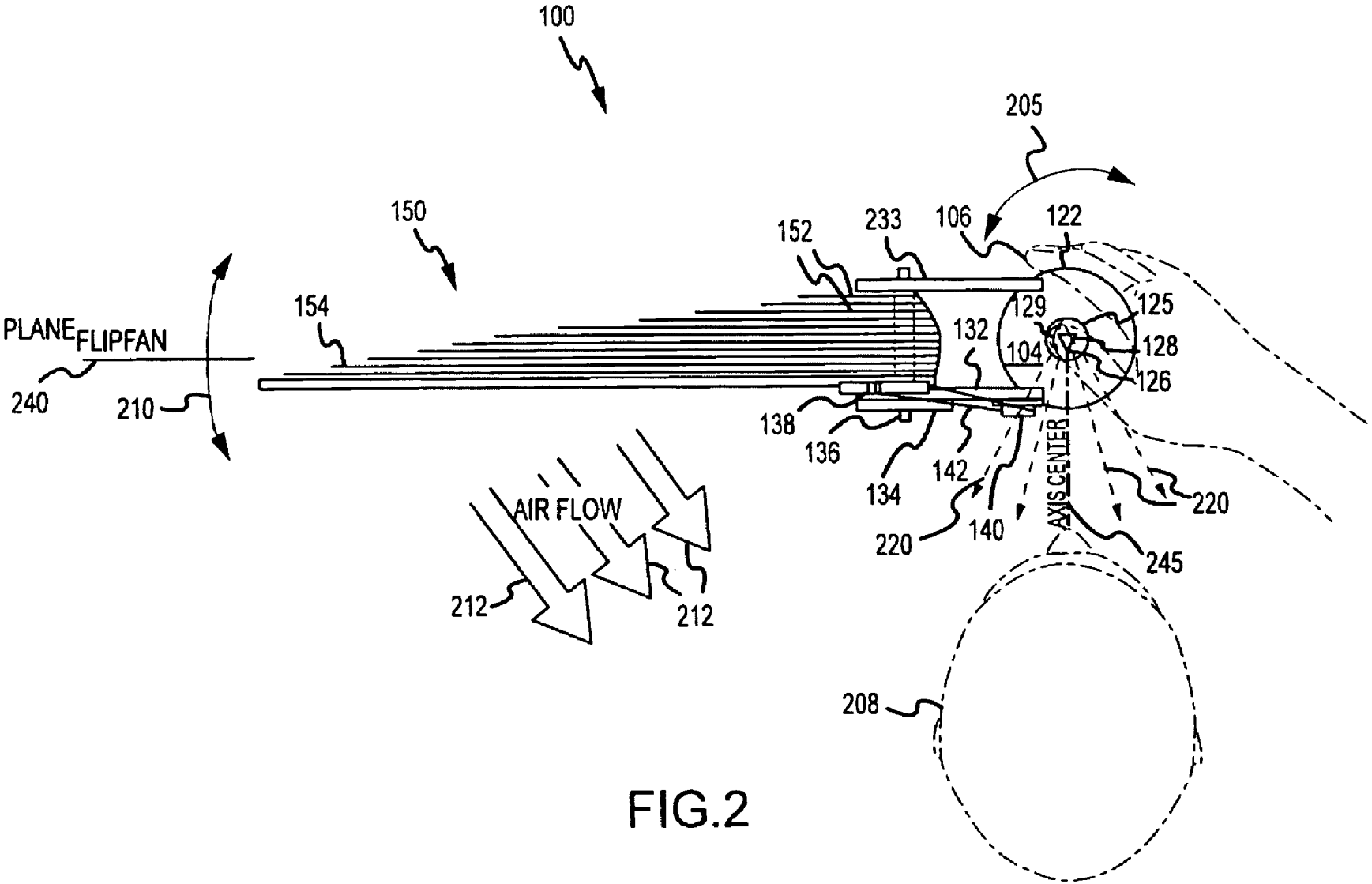
FIG. 2 is top view of the personal misting device of FIG. 1 showing movement of the fan by an operator or user to create air flow and use of the pump assembly to spray water mist or atomized water toward the user.

FIG. 2 illustrates the personal cooling device 100 from above while in use to provide evaporative cooling. As shown, the user's hand 102 is rotating 205 the container 120 to generally rotate or spin about it central axis, but, of course, the container 120 may be moved more to cause the fan blade 154 to move. The movement 205 of the container assembly 110 causes the fan blade 154 to move as shown at 210 to generate a volume of air flow 212 toward a user's face (or other portion of their body) 208. The movement 210 of the fan blade 154 is generally transverse to a plane 240 passing through the fan blade 154 (e.g., the fan has a body that is substantially planar and this planar body is waved 210 to move air). The user 102 may also depress or actuate the pump assembly 124 by pressing down on the lever 128, which causes a volume of atomized water or mist 220 to fly toward the user's face (or other body part) 208. The atomizer nozzle or pump assembly outlet 126 is directed such that a center axis of the spray 220 is along a line 245, with some nozzles 126 having an adjustable outlet stream to control the amount of atomization. After the mist 220 lands on the user's skin 208, the air moved 212 by the fan blade 154 causes it to evaporate, thus cooling the user 102. To facilitate placement of the spray/mist 220, the axis/direction 245 of the nozzle 126 is transverse to the plane 240 of the fan blade 154. In some embodiments, the axis 245 is substantially perpendicular to the plane 240 (such as 80 to 110 degrees relative to the plane 240). In some embodiments, the pump assembly 124 is adapted such that the nozzle 126 may be redirected or aimed as shown at 129 such as to rotate it 180 degrees to switch use for a left or right-handed user.

FIG. 3 illustrates the personal cooling device 100 in the storage or folded/retracted configuration. In this arrangement, the fan blade 154 is folded together and toward the container assembly 110. To this end, the inner segments 152 are rotated about axle 136 and positioned in a stacked or parallel arrangement. A lock or tip 155 may be provided on the blade 154 to extend a small amount more than the rest of the blade 154 to engage or contact the lip/ridge 115 on lower support arm 114 to "lock" or at least resist the blade's movement from the storage position shown in FIG. 3. In this storage or folded arrangement, the elastic or spring member 142 is stretched or elongated, which places it under tension such that when a force is applied to move the tip past the ridge/lip 115 the elastic or spring member 142 applies the tensile force about the fulcrum 134 of upper support arm 132 to assist unfolding or unfurling of the fan blade 154 to the cooling position shown in FIGS. 1 and 2.

Figure 4:
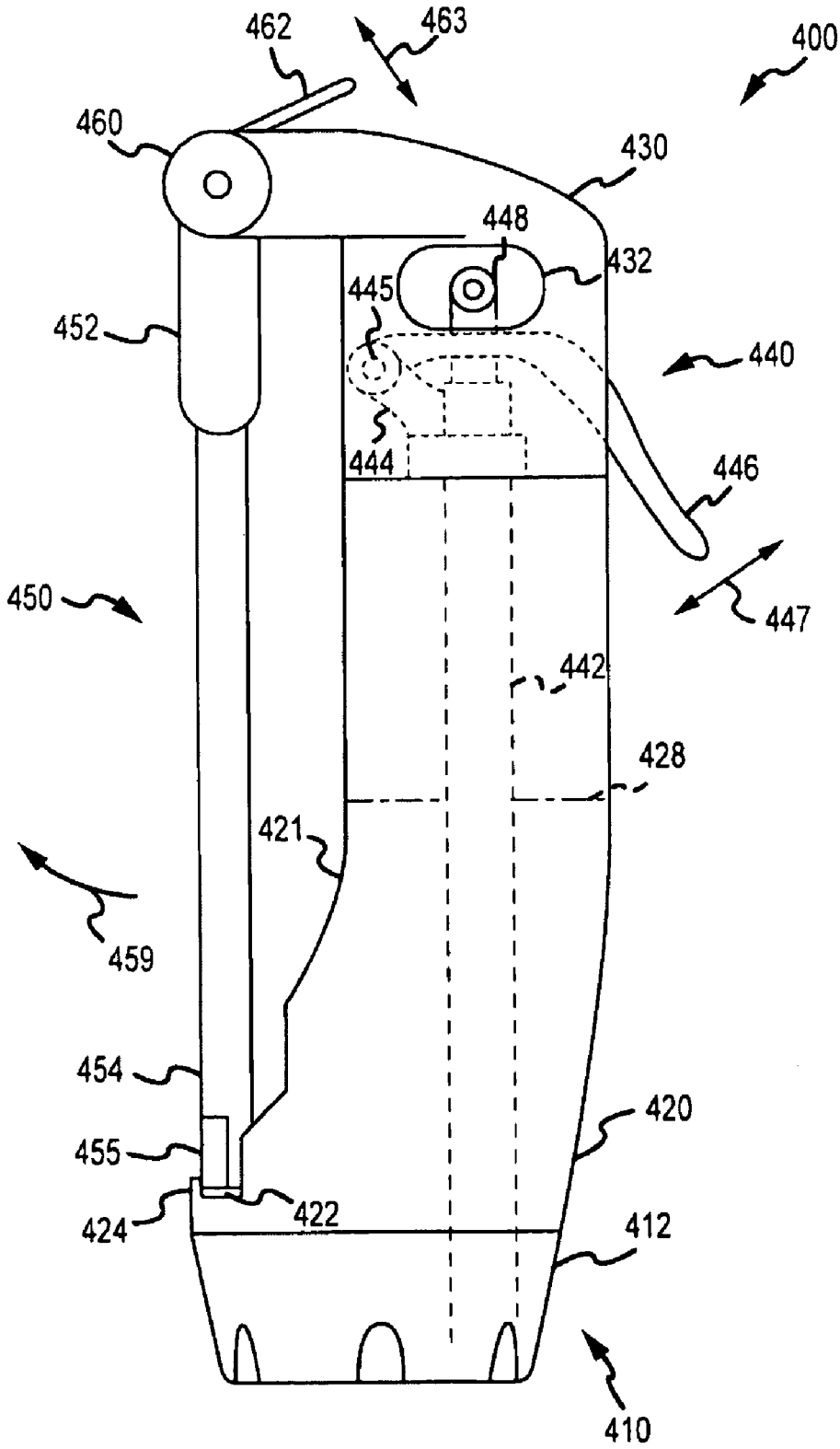
FIG. 4 illustrates a side view similar to FIG. 3 of another embodiment of a personal misting device with a cap over an atomizer nozzle and with a thumb trigger extending from the cap and a torsion spring or other device provided in the cap to function as a retraction mechanism for the folding or flip fan.

With the cooling device 100 of FIGS. 1-3 understood, a number of other embodiments of personal misting assemblies (or extensions/modifications of the inventor's teachings) that combine a flip fan with liquid container having a spray pump with an atomizer will be apparent to those skilled in the art. For example, FIG. 4 illustrates a personal misting device 400 that includes similar components as shown in assembly 100 but in somewhat different configurations and/or designs (e.g., a different look and feel but generally similar functionality). The device 400 includes a container assembly 410 with a base cap 412 that may be removed such as with a threaded fit or a snap fit (resistance fit) to allow the assembly 410 to be filled with a liquid 428 (e.g., water or the like). The assembly 410 also includes a liquid container or vessel 420 with sidewalls 421 formed to facilitate grasping and holding by a user's hands, such as by being smaller diameter at the top or where a person is encouraged to hold the container 420. The container 420 is hollow inside or includes an interior chamber for holding liquid 428 and for receiving a straw or water outlet tube 442 from pump assembly 440. The bottom of the container 420 includes a ledge or recessed surface 422 with a retainer ridge or lip 424 for mating with the tip 455 of the fan blade 454.

The device 400 includes a flip fan or folding fan 450, which is shown in FIG. 4 in the storage mode. In the storage mode, the fan blade 454 is folded upon itself and interconnected inner segments 452 are arranged in parallel in a stack, with the fan blade or body 454 being positioned proximate to the container 420. To use the device 400 for cooling, the fan blade 454 may be unfolded or unfurled as shown at 459 such that it becomes planar in arrangement and typically semicircular in shape (e.g., about half of a circle's area or the like). The inner segments 452 are pivotally supported at one end by a pivotal support mechanism 460. In this embodiment, the mechanism 460 may include an axle/pin for supporting an end of each of the inner segments 452 of the fan blade 454 and also include a spring element such as a torsion spring attached to the axle. The torsion spring of mechanism 460 may store elastic or mechanical energy by being twisted as the fan blade 454 is returned to its folded and locked position as shown in FIG. 4. A release or lever arm 462 may be provided that can act to unlock the torsion spring (e.g., a spring made of wire, ribbon, or bar of metal, rubber, or other material or other spring member) as shown with arrow 463 to provide an amount of force/torque that causes the fan blade 454 to unfold 459 to its cooling or deployed position as shown with arrow 459. With assembly 100, the user typically has to provide a flicking or flipping movement with their wrist to cause the fan blade to unfurl whereas with device 400 the user simply has to push the lever or release 462.

The personal misting device 400 also includes a pump or spray assembly 440 attached to the top of the container 420. The spray assembly 440 includes a cap or cover 430 that may snap onto or thread onto the top of the container 420. The cap 430 includes a portion that extends outward away from the body (e.g., an upper support arm) and that supports the pivotal mounting mechanism 460 for the fan 450. Within or beneath the cap 430, the pump assembly 440 includes a water inlet or suction tube 442 that extends into the container 420 to allow withdrawal of the liquid 428. The tube 442 extends upward to the inlet of an atomizer or spray mechanism 448 that is directed out or extends out from an opening 432 in the cap 430. Again, the cap 430 may include two openings 432 such that the nozzle or outlet of the spray mechanism 448 may be rotated 180 degrees (more or less) to switch the device 400 from right to left-handed use. The atomizer mechanism 448 is attached to the container with base or frame 444 and a trigger or lever arm 446 is pivotally mounted to the base 444 via pin 445 and may be attached to atomizer 448 to cause the atomizer 448 to be moved downward or actuated with movement 447 of the trigger 446. The trigger 446 extends outward and away from the container 420 and is arranged to be operated with an operator's thumb (e.g., to be a thumb trigger) or palm.

Use of the device 400 would be similar to that of device 100. Once the container 420 is filled with a volume of liquid 428, the user may press the lever 462 as shown at 463 to cause the fan blade 454 to unfurl or extend 459. The user may then press the trigger 446 as shown at 447 to cause an atomized volume of the liquid 428 or a mist to be directed toward their skin. The user may then (or concurrently with the pressing 447 of trigger 446) flick their wrist or move their forearm (or otherwise move the container 420) to move the container 420 and to operate the fan 450 to cause the fan blade 454 to push a volume of air toward the skin that has been or is being moistened by the atomizer 448.

Figure 5:
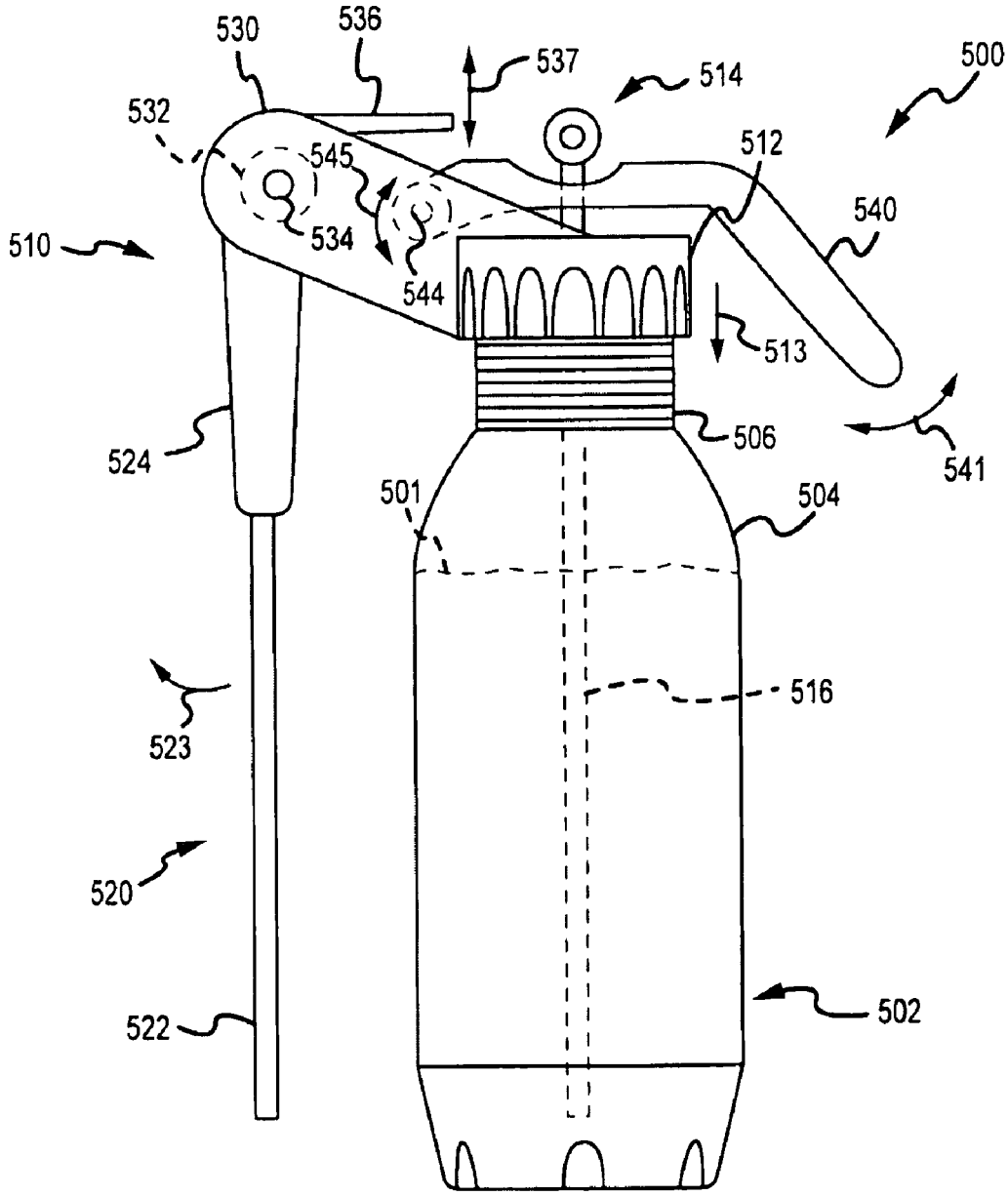
FIG. 5 illustrates a side view similar to FIGS. 3 and 4 of another embodiment of a personal misting device in which a folding fan and spray assembly are provided as an add on attachment to a conventional water bottle.

In some cases, it may be desirable for a personal cooling device to be formed using a conventional container or bottle. FIG. 5 illustrates a personal cooling assembly 500 that is formed from a conventional water bottle 502 that includes a sidewall 504 defining an interior volume or chamber for receiving a liquid 501. The bottle 502 includes a threaded, open top or neck 506. A manually-operated misting assembly 510 is provided that may be attached to the top 506 of the bottle 502 as shown at 513, and, to this end, a threaded cover or cap 512 is provided in the assembly 510. A spray assembly or atomizer 514 is provided on the cap/cover 512 and includes a water inlet or suction tube 516 that extends through the bottle top or neck 506 into the interior chamber and contained liquid 501 (e.g., the tube 516 would typically be a length that allows it to reach the bottom of a particular sized bottle, average bottle size, or to not contact the bottom for a range of bottle sizes).

To activate the spray pump or atomizer 514 the assembly 510 includes a support arm 530 that extends outward from the cap 512 transverse to a longitudinal axis of the bottle 502 so as to allow the fan 520 to be supported away from the bottle 502. The support arm 530 includes a pivot pin or mounting mechanism for a pump trigger 540 (with pivoting shown at 545) that is attached to the atomizer 514 so as to generate a mist or spray from liquid 501 when the trigger 540 is moved or pressed as shown at 541. The assembly 510 also includes a flip fan 520 that can unfurl or deploy as shown at 523 (and as explained with reference to FIGS. 1-3) but is shown in a storage or folded position. The fan 520 includes a foldable fan blade 522 that when unfolded takes on a generally planar and semicircular shape. The fan blade 522 is attached at one end to inner segments 524 that are shown to be stacked in a parallel arrangement (e.g., as a deck of playing cards or the like). The inner segments 524 are pivotally supported on an opposite end to a pin or rod 534 supported by arm 530. As with device 400, a resilient release mechanism 532 is provided, such as a torsion spring, in the support arm 530 and attached to the pivot pin 534 such that when a user presses release or latch 536 stored energy in the mechanism 532 (e.g., energy stored as the fan body 522 is folded manually by an operator back toward the bottle 502) is released causing the blade 522 to unfurl or unfold 523. As with the other designs, the unfurled fan blade 522 allows the assembly 500 not only to be used for evaporative cooling but also allows the user to shade themselves with the blade 522 to provide further cooling by blocking the Sun's rays. The blade 522 may also have information and artwork ("blade branding") provided on its surface area to increase the value of the assembly 500 to the buyer/user (e.g., by including a souvenir or showing their allegiance to a sports team or the like) and/or to the seller (e.g., displaying product/service or brand information).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the particular atomizer nozzle and liquid pump utilized are not limiting to the invention, and it is anticipated that the ideas described herein may be used with numerous spray assemblies. A thumb or finger pump may be used as shown (upper pump as shown in FIGS. 1-3, thumb or rear side pump as shown in FIGS. 4 and 5) or in different arrangements than those shown. In other cases, the trigger may be provided as part of the fan (e.g., the portion attached to the container support arms may be squeezed to trigger the pump). In other cases, the palm of the hand may be used with the trigger provided on the side of the container or bottle or the bottle/container may be soft and flexible such that the user may simply be able to trigger the spray by squeezing the container to cause liquid to be discharged from the atomizer nozzle. Some embodiments may not include the resilient deployment mechanisms shown, and the user may simply/fully manually operate the fan blade (and, optionally, to manually lock it in the deployed/cooling and folded/storage positions).

I claim:

1. A handheld misting device, comprising:

a container with a body adapted for being held in an operator's hand, the container including an interior chamber for receiving a volume of liquid;

a misting assembly supported on an upper end of the body with an inlet tube extending into the interior chamber, an atomizer, and a pump manually operable via a manually-operable trigger mechanism to draw the liquid through the inlet tube and out of an outlet of the atomizer as a mist;

a fan assembly supported by the upper end of the body and including a retractable fan blade, wherein the fan blade is positionable in a first position in which the fan blade is folded together and position proximate to the container body and in a second position in which the fan blade is unfolded into a substantially planar configuration; and a cap extending from the body with a support for pivotally mounting the fan blade to the container.

2. The device of claim 1, wherein the fan blade includes fabric sheet and a plurality of planar inner segments pivotally attached at a first end to the cap and attached at a second end to an inner edge of the fabric sheet of the fan blade.

3. The device of claim 2, wherein the cap includes a spring release mechanism coupled to the inner segments to, when actuated, apply a force to the inner segments to move the fan blade from the first position to the second position with the fabric sheet in the substantially planar configuration.

4. The device of claim 1, wherein the atomizer comprises a nozzle including the outlet that extends outward from an opening in the cap and that discharges the mist in a direction that is transverse to a plane containing the fan blade in the second position.

5. A handheld misting device, comprising:

a container with a body adapted for being held in an operator's hand, the container including an interior chamber for receiving a volume of liquid;

a misting assembly supported on an upper end of the body with an inlet tube extending into the interior chamber, an atomizer, and a pump manually operable via a manually-operable trigger mechanism to draw the liquid through the inlet tube and out of an outlet of the atomizer as a mist;

a fan assembly supported by the upper end of the body and including a retractable fan blade; and a cap extending from the body with a support for pivotally mounting the fan blade to the container, wherein the trigger mechanism includes a thumb trigger extending outward from the cap at a location distal to the fan blade and wherein the body of the container includes a protruding shelf and an edge of the fan blade is affixed to the shelf, whereby an edge of the fan blade remains positioned proximate to the container body when the fan blade is unfolded.

6. The device of claim 5, wherein the fan blade is positionable in a first position in which the fan blade is folded together and position proximate to the container body and in a second position in which the fan blade is unfolded into a substantially planar configuration.

7. The device of claim 6, wherein the fan blade includes fabric sheet and a plurality of planar inner segments pivotally attached at a first end to the cap and attached at a second end to an inner edge of the fabric sheet of the fan blade.

8. The device of claim 7, wherein the cap includes a spring release mechanism coupled to the inner segments to, when actuated, apply a force to the inner segments to move the fan blade from the first position to the second position with the fabric sheet in the substantially planar configuration.

9. The device of claim 5, wherein the atomizer comprises a nozzle including the outlet that extends outward from an opening in the cap and that discharges the mist in a direction that is transverse to a plane containing the fan blade in the second position.

10. The device of claim 5, wherein the atomizer outlet is positionable in a first position targeted in a direction in a range of about 80 to 110 degrees from a plane passing through the unfolded fan blade and in a second position targeted in a direction in a range of about 260 to 280 degrees from the plane passing through the unfolded fan blade.

11. The device of claim 5, wherein the container includes a removable lid providing access to the interior chamber adapted for storing the liquid, whereby the container is refillable with water or other liquids.

12. The device of claim 5, wherein the container comprises an elongate body including the interior chamber and wherein the fan blade comprises a fabric sheet having a semi-circular, planar shape when unfolded and wherein a plane containing the unfolded fabric sheet also contains a central axis of the body of the container.

13. The device of claim 12, wherein the atomizer outlet is positionable to be targeted to discharge the mist transverse to the fabric sheet.

14. A personal misting assembly, comprising:

a spray mechanism comprising a manually-operable pump, a tube connected to the pump for drawing liquid from a container upon operation of the pump, and an atomizer nozzle for discharging the pumped liquid as a mist;

a fan assembly comprising a plurality of planar segments arranged in a stack and pivotally mounted to a support arm at a first end, the fan assembly also including a fabric sheet attached along an inner edge to second ends of the planar segments and the fan assembly being positionable in a storage position with the fabric sheet being folded upon itself and in a cooling position with the fabric sheet being unfolded; and a cap supporting the spray mechanism and an arm extending out from the cap upon which the planar segments are pivotally mounted, wherein the cap coupled to an open end of the container and wherein the fabric sheet is substantially planar when unfolded and wherein the atomizer nozzle is targeted to discharge the mist transverse to the fabric sheet.

15. The assembly of claim 14, wherein the spray mechanism comprises a trigger for operating the pump that is operable by a finger, thumb, or palm of an operator and wherein the atomizer nozzle is positionable in a first position with its outlet targeted in a direction in a range of about 80 to 110 degrees from a plane passing through the unfolded fan blade and in a second position with its outlet targeted in a direction in a range of about 260 to 280 degrees from the plane passing through the unfolded fan blade.

16. The assembly of claim 14, further comprising the container and wherein the container includes a removable lid providing access to an inner chamber adapted for storing the liquid, whereby the container is refillable with water or other liquids.

17. The assembly of claim 16, wherein the container comprises an elongate body including the inner chamber and wherein the fabric sheet a semi-circular, planar shape when unfolded and wherein a plane containing the unfolded fabric sheet also contains a central axis of the elongate body of the container.

* * * * *